US009574843B2

(12) United States Patent
Itz et al.

(10) Patent No.: US 9,574,843 B2
(45) Date of Patent: Feb. 21, 2017

(54) APPARATUS FOR CORRECTING TRAJECTORIES OF PROJECTILES LAUNCHED FROM FIREARMS

(71) Applicant: MAGNETOSPEED LLC, Austin, TX (US)

(72) Inventors: Garet L. Itz, Austin, TX (US); Weston D. Petersen, Austin, TX (US); Alex J. Sitzman, Austin, TX (US)

(73) Assignee: MAGNETOSPEED LLC, Austin, TX (US)

( * ) Notice: Subject to any disclaimer, the term of this patent is extended or adjusted under 35 U.S.C. 154(b) by 492 days.

(21) Appl. No.: 14/192,406

(22) Filed: Feb. 27, 2014

(65) Prior Publication Data

US 2016/0238338 A1 Aug. 18, 2016

(51) Int. Cl.
*F41B 6/00* (2006.01)
*F41A 21/32* (2006.01)

(52) U.S. Cl.
CPC ..... *F41B 6/003* (2013.01); *F41A 21/32* (2013.01)

(58) Field of Classification Search
CPC ..... F41B 6/003; F41A 21/32
USPC ..... 124/3
See application file for complete search history.

(56) References Cited

U.S. PATENT DOCUMENTS 3,860,199 A * 1/1975 Dunne ..... F41G 7/266 102/480
4,899,956 A * 2/1990 King ..... G05D 1/12 102/293
4,935,697 A * 6/1990 Paesch ..... G01P 3/665 324/160
5,631,654 A * 5/1997 Karr ..... G01S 11/12 250/342
5,788,180 A * 8/1998 Sallee ..... F41G 7/222 244/3.15
6,345,785 B1 * 2/2002 Harkins ..... F42B 15/01 244/3.1
7,467,761 B2 * 12/2008 Yehezkeli ..... F41G 3/10 102/501
8,464,451 B2 * 6/2013 McRae ..... F41A 17/06 42/1.01
9,255,776 B1 * 2/2016 Barton ..... G01P 3/665
2008/0039962 A1 * 2/2008 McRae ..... F41A 17/06 700/90
2008/0142591 A1 * 6/2008 Jenkins ..... F41G 7/346 235/411
2008/0190191 A1 * 8/2008 Martin ..... G01P 3/665 73/167
2011/0059421 A1 * 3/2011 Hickman ..... F41G 3/04 434/16
2016/0238338 A1 * 8/2016 Itz ..... F41A 21/32

* cited by examiner

*Primary Examiner* — Samir Abdosh
(74) *Attorney, Agent, or Firm* — Russell Ng PLLC; Antony P. Ng

(57) ABSTRACT

An apparatus for correcting trajectories variations of projectiles launched from a firearm is disclosed. The apparatus includes a control circuit for determining an appropriate impulse to be imparted into a projectile based on the measured velocity of the projectile, at least one steering coil, and a pulsed-power supply for discharging an amount of energy commensurate with the determined impulse to the steering coil such that a set of magnetic fields is produced to impart an amount of corrective kinetic energy into the projectile as the projectile passes the steering coil.

8 Claims, 2 Drawing Sheets

APPARATUS FOR CORRECTING TRAJECTORIES OF PROJECTILES LAUNCHED FROM FIREARMS

BACKGROUND OF THE INVENTION

1. Technical Field

The present invention relates to projectile trajectory correction in general, and in particular to an apparatus for correcting trajectories of projectiles launched from firearms.

2. Description of Related Art

At long-range target shootings, small variations in bullet velocity can result in major differences in impact points. Long-range shooters try to mitigate any errors caused by velocity variations via the usage of very precise ammunition. However, those errors cannot be completely eliminated, and as the long-range shooters continue to attempt longer shots, errors stemmed from velocity variations become increasingly significant. Advanced optics, wind measurement systems, and computer-controlled firing systems make shot-to-shot velocity variations still more noticeable and important.

Consequently, it would be desirable to provide an apparatus for correcting velocity variations of projectiles launched from firearms.

SUMMARY OF THE INVENTION

In accordance with a preferred embodiment of the present invention, an apparatus for correcting trajectories of projectiles launched from a firearm includes a control circuit for determining an appropriate impulse to be imparted into a projectile based on the measured velocity of the projectile, at least one steering coil, and a pulsed-power supply for discharging an amount of energy commensurate with the determined impulse to the steering coil such that a set of magnetic fields is produced to impart an amount of corrective kinetic energy into the projectile as the projectile passes the steering coil.

All features and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 1:
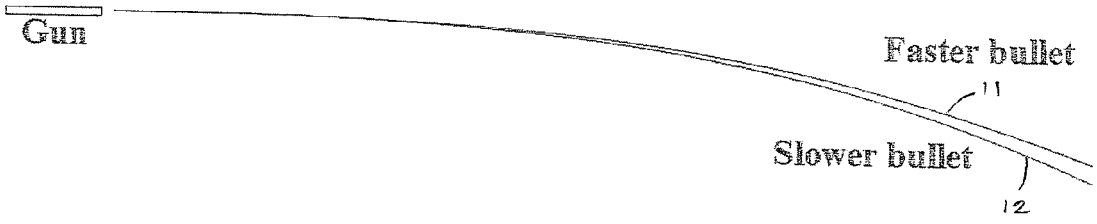
FIG. 1 illustrates two bullet trajectories for two substantially identical bullets.

Referring now to the drawings and in particular to FIG. 1, there is illustrated two bullet trajectories for two substantially identical bullets. As shown, a first bullet travels along a bullet trajectory 11, and a second bullet travels along a bullet trajectory 12, even though the first and second bullets are substantially identical to each other. The only difference between the first and second bullets is their respective velocities.

A trajectory correction device (TCD) is a solution to the problem of shot-to-shot velocity variations, as illustrated in FIG. 1. Mounted to the muzzle of a firearm, a TCD can detect the velocity of a bullet and make the necessary correction by imparting a kinetic impulse to the bullet as the bullet passes the steering coils located at the end of the TCD. Specifically, TCD detects the velocities of bullets and then uses a set of pulsed-electromagnets to make small adjustments in the bullets' trajectories to correct for velocity variations by pushing the bullets up or down as they pass the steering coils within the TCD.

Figure 2:
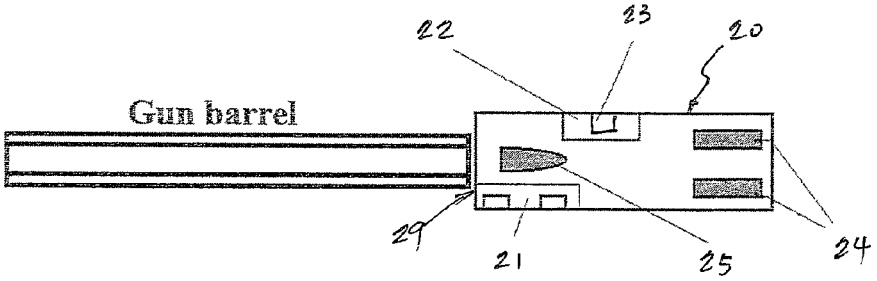
FIG. 2 shows the main components of a velocity correction device, in accordance with a preferred embodiment of the present invention.

With reference now to FIG. 2, there is depicted the main components of a TCD, in accordance with a preferred embodiment of the present invention. As shown, a TCD 20 includes a ballistic chronograph 21, a control circuit 22, a pulsed-power supply 23 and one or more steering coils 24. TCD 20 is configured to attach to a muzzle 29 of a firearm such as a rifle, handgun, etc. Ballistic chronograph 21 measures the velocity of a bullet 25 shortly after it comes out of muzzle 29 of the firearm. Alternatively, ballistic chronograph 21 can measure the velocity of bullet 25 within the barrel of the firearm itself if TCD 10 has been completely integrated into the firearm. Although ballistic chronograph 21 is shown to be included within TCD 20, it is understood by those skilled in the art that ballistic chronograph 21 can be a separate device from TCD 20.

After ballistic chronograph 21 has obtained the velocity of bullet 25, ballistic chronograph 21 sends the information to control circuit 22 in which an appropriate impulse to impart into bullet 25 is calculated. Alternatively, instead of using projectile velocities as inputs, TCD 20 can use wind speed information as inputs for the above-mentioned impulse calculation. The wind speed information can be obtained via an anemometer, and the wind speed information is utilized to correct for projectile trajectory variations caused by cross-wind.

For the most accurate correction at the target, the distance between muzzle 29 and a target should already be known by control circuit 22. However in many cases, it will be sufficient to only roughly know the distance between muzzle 29 and the target. Pulsed-power supply 23 then discharges an appropriate amount of energy to steering coils 24 and the magnetic fields produced by steering coils 24 impart a small amount of corrective kinetic energy into bullet 25 as bullet 25 passes through steering coils 24 (which is approximately a 10 μs to 30 μs time window).

For the design of sterring coils 24, a single-turn drive coil is ideal because its proximity to bullets requires it to experience the harsh environment of a gun's muzzle, and turn-to-turn insulation is generally too weak to survive. A pulse transformer can be utilized to step up the current though electromagnetic induction within steering coils 24.

Many different pulse-power circuits can be employed within TCD 20, but given the time scales and energies involved, it preferably includes one or more banks of pre-charged capacitors and two or more discharge-type switches such as thyristors. Several modulation schemes for controlling the amount of energy imparted into bullet 25 are possible, such as splitting pulsed-power supply 23 into several banks that can be selectively discharged, or simply by delaying the discharge of the capacitors until bullet 25 is partially past steering coils 24.

Most bullets of interest are copper-jacketed and includes only non-magnetic materials, so copper jacketed bullets will be used as examples for the present disclosure. However, in principle, TCD 20 is also applicable to bullets with ferromagnetic or permanent magnetic material, though the interactions with steering coils 24 will differ. TCD 20 adjusts the trajectories by energizing one or more steering coils 24 as bullet 25 passes. Steering coils 24 produce a magnetic field that repels conductive projectiles through electromagnetic induction, attracts ferromagnetic bullets by alignment of magnetic dipoles, or interacts with permanent magnets within the projectile.

Figure 3A:
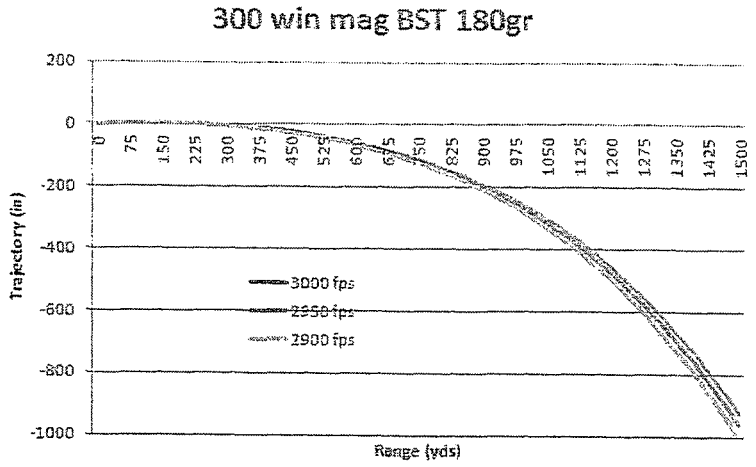
FIG. 3A shows the trajectory of various bullets and trajectories corresponding to a ±50 ft/s muzzle velocity variation.

Referring now to FIG. 3, there is illustrated the forces and energies involved in steering coils 24's interactions with bullets. A sniper rifle in 300 Win Mag is a typical platform for long range engagement out to 1,500 yards. A 180 grain projectile fired from this sniper rifle at 2,950 ft/s will reach 1,500 yards in approximately 2.28 seconds. The trajectory of various bullets can be seen in FIG. 3A as well as trajectories corresponding to a ±50 ft/s muzzle velocity variation. A spread of this magnitude would deem those bullets to be of poor-average quality. The difference in vertical hit location between the extreme variations in velocity versus range can be seen in FIG. 3A.

Figure 3B:
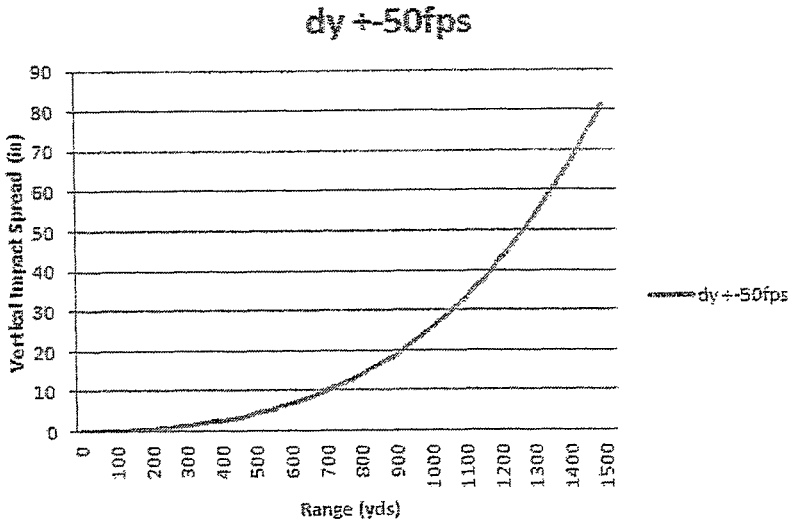
FIG. 3B shows various variances on vertical target impact location.

Due to the above-mentioned variation in muzzle velocity, an approximately 80 inch variance on vertical target impact location can be observed in FIG. 3B, which allows a bullet to easily miss its intended target. To handle the discrepancy in muzzle velocity's effect on hit location, an ability to "push" a bullet up or down by 40" is needed. The push is to be done via an impulse of an electromagnetic pulse over a very short duration on a bullet just upon muzzle exit. This impulse will give the bullet a small vertical velocity either up or down to account for the true muzzle velocity's difference from the firing solution. The true muzzle velocity can be determined at the muzzle exit and within microseconds, the pressure pulse magnitude, direction, and profile can be calculated and applied to the bullet in free flight.

In order to move the bullet up or down on target, taking the vertical offset needed and divide it by time of flight will give the vertical velocity needed to be imparted to the bullet. Multiplying this velocity by the mass yields the rough change in momentum (i.e., impulse) needed. For the above-mentioned example, the maximum vertical velocity needed can be calculated by dividing 40 inches (1.016 m) by 2.28 seconds to yield 0.46 m/s. Multiplying by 180 grains (0.0117 kg) gives a required impulse of 0.0052 N-s.

In the case where an impulse of 0.08 N-s is required, TCD 20 would have to exert about 8 kN of force on a bullet over about 10 μs as the bullet passes steering coils 24. If one assumes the coil-bullet interaction surface covers about 0.25 $in^2$ (160 $e^{-6}$ $m^2$), then the approximate magnetic field required would be about 11 T. This is well within the capabilities or normal materials such as copper, aluminum and fiber glass (for insulation). The energy required to produce this magnetic field is approximately 2 J to 3 J, and the total stored energy in TCD 20 should be about 10 J. Advanced switch and capacitor technology should enable TCD 20 to fit in a silencer-type suppressor footprint.

As has been described, the present invention provides an apparatus for correcting trajectory variations of projectiles launched from firearms. The apparatus of the present invention is designed to be a compact device and as such it cannot store much potential energy. It should have a negligible impact on the bullets' actual velocity because doing so would simply require too much energy for an acceptably-sized apparatus located on a muzzle.

While the invention has been particularly shown and described with reference to a preferred embodiment, it will be understood by those skilled in the art that various changes in form and detail may be made therein without departing from the spirit and scope of the invention.

What is claimed is:

1. An apparatus for correcting trajectory variations of projectiles launched from a firearm, said apparatus comprising:

a ballistic chronograph for measuring a velocity of a projectile;

a control circuit for determining an appropriate impulse to be imparted into said projectile in response to said measured velocity of said projectile;

at least one steering coil; and a pulsed-power supply for discharging an amount of energy, which is commensurate with said determined impulse, to said at least one steering coil to generate a set of magnetic fields for imparting an amount of corrective kinetic energy into said projectile as said projectile passes said at least one steering coil.

2. The apparatus of claim 1, wherein said pulse-power supply includes a plurality of capacitors.

3. The apparatus of claim 1, wherein said pulse-power supply includes a plurality of discharge-type switches.

4. The apparatus of claim 1, wherein said pulse-power supply includes a plurality of thyristors.

5. An apparatus for correcting trajectory variations of projectiles launched from a firearm, said apparatus comprising:

a control circuit for determining an appropriate impulse to be imparted into a projectile in response to wind speed information from an anemometer;

at least one steering coil; and a pulsed-power supply for discharging an amount of energy, which is commensurate with said determined impulse, to said at least one steering coil to generate a set of magnetic fields for imparting an amount of corrective kinetic energy into said projectile as said projectile passes said at least one steering coil.

6. The apparatus of claim 5, wherein said pulse-power supply includes a plurality of capacitors.

7. The apparatus of claim 5, wherein said pulse-power supply includes a plurality of discharge-type switches.

8. The apparatus of claim 5, wherein said pulse-power supply includes a plurality of thyristors.

* * * * *